US006695429B2

(12) United States Patent
Barinaga

(10) Patent No.: US 6,695,429 B2
(45) Date of Patent: Feb. 24, 2004

(54) FLUID ASSISTED PRINTHEAD BLOTTER FOR AN INKJET PRINTER SERVICE STATION

(75) Inventor: John Barinaga, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 60 days.

(21) Appl. No.: 09/782,369

(22) Filed: Feb. 12, 2001

(65) Prior Publication Data

US 2002/0109745 A1 Aug. 15, 2002

(51) Int. Cl.[7] ..... B41J 2/165
(52) U.S. Cl. ..... 347/28; 347/33
(58) Field of Search ..... 347/22, 29, 31, 347/33, 28, 32

(56) References Cited

U.S. PATENT DOCUMENTS 4,528,996 A * 7/1985 Jones ..... 347/28
5,432,539 A * 7/1995 Anderson ..... 347/33
5,635,965 A 6/1997 Purwins et al. ..... 347/31
5,706,038 A 1/1998 Jackson et al. ..... 347/33
5,793,390 A * 8/1998 Claflin et al. ..... 347/33
5,905,514 A * 5/1999 Rhoads et al. ..... 347/33
5,963,228 A 10/1999 Purwins ..... 347/31
6,017,110 A 1/2000 Jackson ..... 347/33
6,224,186 B1 * 5/2001 Johnson et al. ..... 347/28

FOREIGN PATENT DOCUMENTS

JP 405064895 * 3/1993 ..... 347/33

* cited by examiner

*Primary Examiner*—Shih-Wen Hsieh

(57) ABSTRACT

A printhead blotter system includes a supply of blotter material in roll form and a blotter backer structure. The blotter is passed over the backer. A fluid dispenser is mounted to the blotter backer for dispensing a cleaning fluid onto the blotter portion held against the backer surface. A mechanism is coupled to the backer to move the backer toward the printhead to an engagement position, or away from the printhead to a rest position. The mechanism can engage/disengage the blotter portion supported over the fabric backer with the printhead orifice plate.

36 Claims, 2 Drawing Sheets

FLUID ASSISTED PRINTHEAD BLOTTER FOR AN INKJET PRINTER SERVICE STATION

TECHNICAL FIELD OF THE INVENTION

This invention relates to service stations for inkjet printers, and more particularly to a printhead blotter for the service station.

BACKGROUND OF THE INVENTION

Previous inkjet service stations have typically included wipers and caps to maintain printhead health. These components have been fairly effective in the past at keeping printheads healthy.

A method which has been used to revive failing printheads during development work for printheads is to blot the printhead with a wet fabric sheet. The fabric sheet is wetted with de-ionized water, and then pressed up against the orifice plate. The water in the fabric dissolves any plugs in the orifices, and the capillary draw of the textile sheet flushes ink out of the nozzles, which in effect primes them. A wet textile sheet works fairly well to recover nozzles, and when wiping alone with a service station does not work, the wet wipe sheet is usually employed.

SUMMARY OF THE INVENTION

A printhead blotter system is describes that allows the printhead to be blotted by a blotter that is pre-wetted by de-ionized water. The wet wipe blotter system is an additional tool to use in maintaining good nozzle health, which can prolong the life of a printhead and improve print quality consistency throughout the life of a product.

In an exemplary embodiment, a printhead blotter system is described for an inkjet printing system employing an inkjet printhead with an orifice plate or nozzle array for ejecting droplets of ink. The blotter system includes a blotter member, and a backer structure for supporting a portion of the blotter member to be used for a given blotting operation. The blotter portion is passed over the backer structure during the blotting operation. A fluid dispenser dispenses a cleaning fluid onto the blotter portion or the backer member. A mechanism is coupled to the backer structure to move the backer toward the printhead orifice plate to an engagement position, or away from the printhead to a rest position. The mechanism engages or disengages the blotter portion with the printhead orifice plate. The blotter system can include a dispenser system for supporting the blotter relative to the backer structure and moving the blotter to move a used portion of the blotter away from the backer structure and position a fresh blotter portion over the backer structure.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENTS

Figure 1:
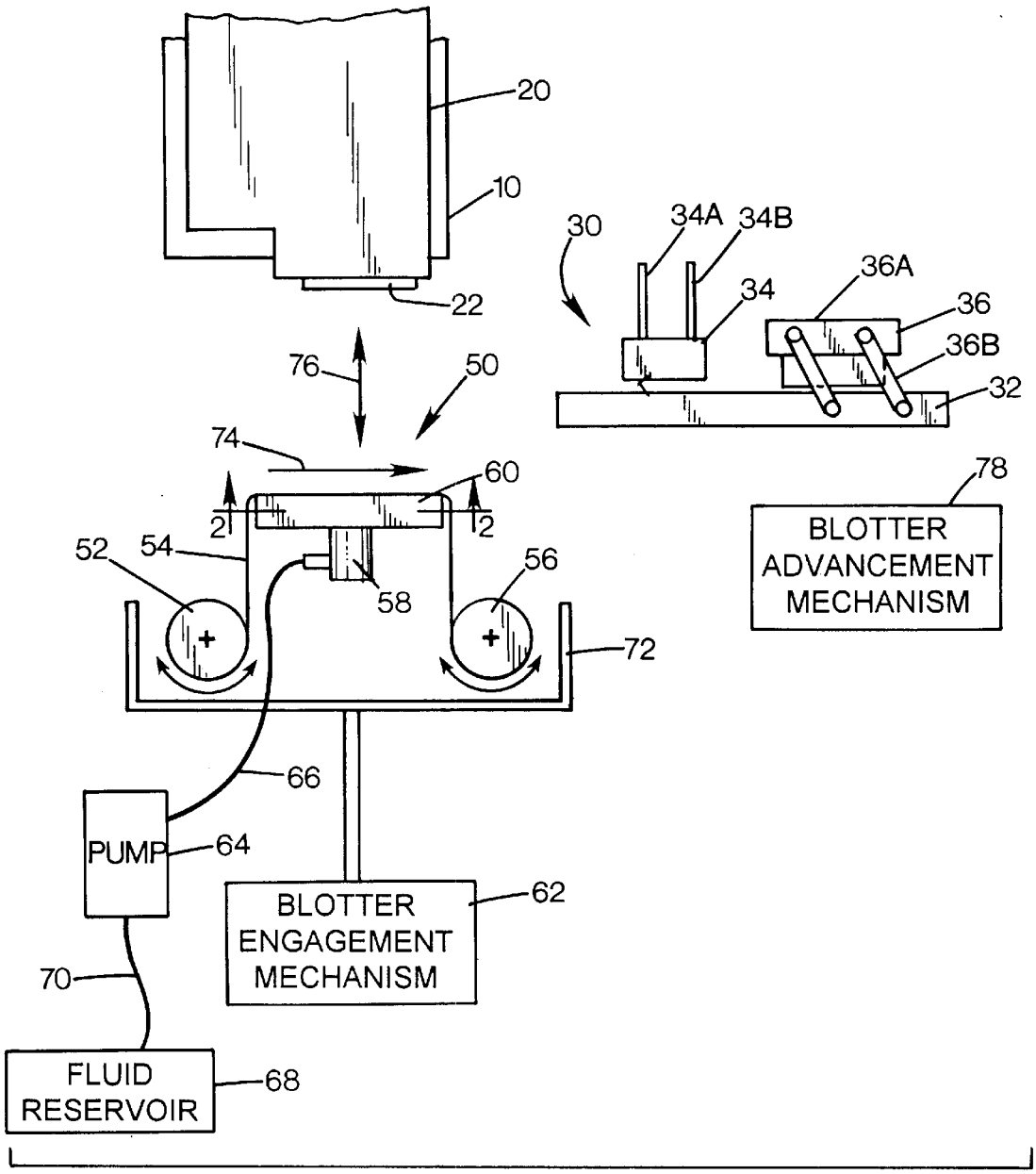
FIG. 1 is a schematic diagram illustrating a printhead blotting system in accordance with the invention.

A printhead blotting system 50 in accordance with an aspect of the invention is diagrammatically illustrated in FIG. 1. An inkjet printhead 20 has mounted thereon a printhead 22 comprising a nozzle array comprising an array of nozzle orifices. In one typical application, the printhead 20 can be employed in an inkjet printing system with a traversing carriage 10, and the printhead mounted in the carriage. A service station 30 is located at one end of the carriage travel path. The service station 30 includes a sled 32 which carries a wiper raft 34 which carries a set of wiper blades 34A, 34B, and a capping mechanism 36 which includes a nozzle array cap 36A and an elevator mechanism 36B for lifting the cap 36A to a capping position. The wipers and cap are conventional tools to maintain printhead health.

The printhead blotter system 50 includes a blotter feed roll 52 which holds a supply of blotter material 54 in roll form, and a blotter take-up roll 56. The blotter material is preferably a soft absorbent material which will wick a liquid into the material, i.e. absorb the liquid through capillary action. In one exemplary form, the material is a cotton fabric such as the material used in the product marketed as the "Texwipe TX304" by Texwipe Company LLC, Upper Saddle River, N.J., formed into a long strip or web. The blotter material need not be a woven material, and other materials such as a polyester fiber material formed into a web or strip can also be employed. The blotter material 54 preferably has a width slightly larger than the width of the printhead nozzle structure to be blotted. In a typical application, the width will be no greater than about 1 inch to about 1.5 inch, although this of course will depend on the application. The length of the roll of the blotter material will be tailored to the application demands, and typically on the order of tens of feet in length. For high use machines, a longer roll would typically be indicated. The thickness of the material will depend on the type of blotter material; a typical thickness range is about 0.25 mm to about 0.75 mm.

The feed roll 52 and the take-up roll 56 are positioned on opposite sides of a blotter backer 60, and the blotter material 54 is passed over the backer 60. A fluid dispenser 58 is mounted to the blotter backer 60 for dispensing a cleaning fluid onto the blotter portion held against the backer surface. In an exemplary embodiment illustrated in FIG. 2, the blotter backer 60 is fabricated of a hard plastic material, with a compliant layer 61 formed of a rubber or elastomeric material, with a low durometer characteristic. The compliant layer 61 contacts the blotter portion disposed between the backer 60 and the printhead. The dispenser 58 preferably includes a plurality of distributed holes 61A or passageways formed in the compliant layer, with a form of manifold structure 60A to feed the fluid to the holes, to form a "shower head" like fluid dispenser.

The feed roll 52, the take-up roll 56, the fluid dispenser and the backer 60 can all be supported on a blotter bracket 72 for movement along arrow 76.

The system 50 further includes a mechanism 62 coupled to the backer 60 through bracket 72 to move the backer 60 toward the printhead 22 to an engagement position, or away from the printhead to a rest position (illustrated in FIG. 1). Thus, the mechanism 62 can engage/disengage the portion of the blotter supported over the blotter backer with the printhead orifice plate. The mechanism 62 can take many different forms. The mechanism 62 can be a cam driven system relying on movement of another mechanical element such as the service station sled to move the backer 60.

Alternatively, the mechanism 62 can be a motor-driven system with its own motor drive. The mechanism 62 can include gearing such as a rack and pinion gear drive. A spring-loading can be incorporated into the mechanism 62 so that the backer 60 returns downwardly to the rest position when the drive force is removed.

The system 50 also includes a fluid pump 64 that feeds the fluid dispenser 58 through a conduit 66 such as a flexible tubing, and a fluid reservoir 68 that feeds the pump 64 through a conduit 70. The pump 64 can be an electrically-driven pump, e.g. a diaphragm pump. Alternatively, the fluid reservoir 66 can be placed in a position elevated with respect to the fluid dispenser and backer, and the pump replaced by a valve which opens/closes to control the release of the cleaning fluid to the dispenser. The valve can be electrically controlled, or actuated by movement of the backer 60 upwardly to engage the blotter with the printhead.

The system further includes a blotter advancement mechanism 78 for incrementally advancing the blotter material from the feed roll to the take-up roll. In one embodiment, the mechanism 78 indexes the blotter material by a predetermined length, e.g. the length of the printhead structure to be blotted to present a fresh portion of the blotter material for the next blotting procedure. Alternatively the predetermined length can be less than the length of the printhead structure to conserve blotter material. The mechanism 78 can be coupled to the take-up roll 56, and can comprise a ratchet mechanism which uses the up/down movement of the bracket 72 to turn the roll 56. Other mechanisms could alternatively be employed for this purpose, including motor-driven mechanisms or even spring-loaded mechanisms.

While the feed roll 52 and take up roll 56 are illustrated as being disposed on opposite sides of the backer 60, the rolls could alternatively be disposed on the same side to conserve space, with a blotter guide structure provided to route the blotter member 54 from the opposite side of the backer back to the take up roll.

Figure 2:
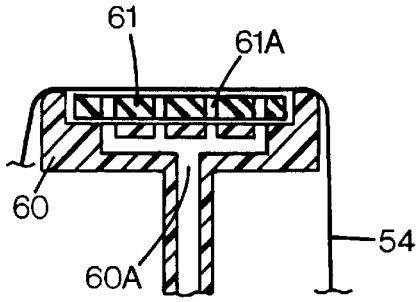
FIG. 2 is a cross-sectional view taken through line 2—2 of FIG. 1.
Figure 3:
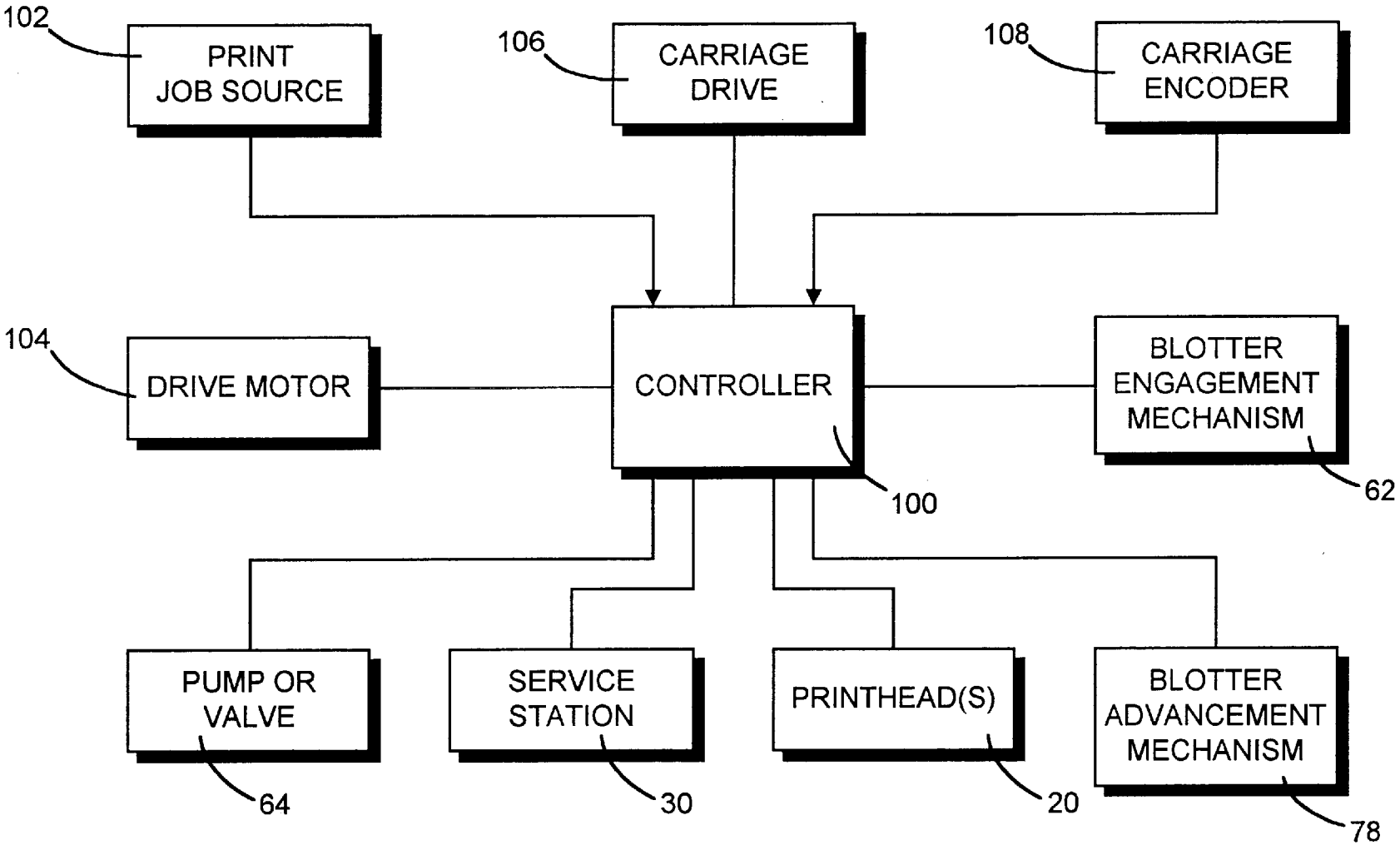
FIG. 3 is a schematic block diagram of the control system for an exemplary inkjet printer employing the blotting system of FIGS. 1–2.

FIG. 3 is a schematic block diagram of the control system for an exemplary inkjet printer employing the blotting system 50 of FIGS. 1–2. A controller 100 such as a microcomputer receives print job commands and data from a print job source 102, which can be a personal computer, digital camera or other known source of print jobs. The controller activates a drive motor system 104 to advance a print medium to a print zone. A carriage drive 106 is driven by the controller to position the carriage 10 for commencement of a print job, and to scan the carriage along slider rods. As this is done firing pulses are sent to the printhead(s) 20. The controller receives encoder signals from the carriage encoder 108 to provide position data for the carriage. The controller is programmed to advance incrementally the sheet to position the print medium for successive swaths, and to eject the completed print medium into an output tray.

The controller 100 also controls the service station 30 and the blotter system. The controller sends control signals to the carriage drive 106, the blotter engagement mechanism 62, the pump or valve 64, and the blotter advancement mechanism 78 to position the printhead 20 at the backer 60 and to perform a blotting procedure.

The operation of the printhead blotting system is as follows. The carriage 10 is moved into the service station to prepare for a printhead service event. A normal wipe event using the wipers 34A, 34B can occur to clean off any large debris from the orifice plate, such as paper fibers, dust, large pieces of crusted ink, and the like. The blotter advancement mechanism 78 is actuated to bring a new clean section of the blotter material over the fluid dispenser 58 and blotter backer 60. The fluid pump 64 is turned on and fluid is dispensed into the blotter section positioned over the backer 60. The fluid dispenser 58 and blotter backer 60 is raised up by positioning mechanism 62 to make contact with the orifice plate 22. The printhead is now blotted and cleaned as the wet blotter section is in contact with the orifice plate. The blotter backer is then lowered back into its original position. The length of time the wet blotter is in contact with the orifice array will depend on the particular application. A typical blotting time interval is about 5 seconds.

Different variations of the foregoing operation can be performed, for example, blotting without dispensing fluid (i.e. a dry blot), dispensing fluid after engaging the blotter with the orifice plate, actuating the printhead to spit ink through the orifice plate while blotting, dispensing fluid several times or increments for a single blotting procedure, successively performing repeated blotting operations for the same printhead, and slightly moving or dithering the carriage when the blotter is engaged to get some wiping effect. Also, normal servicing can be integrated into the service operation, i.e. normal spitting, wiping, drop detection, and so on.

For some applications, the blotter roll could be replaced with a blotter member such as a sponge that is wetted with the fluid and is used over and over for blotting operations. This can be suitable for low-cost printer applications, or for applications which do not heavily use the wet blotting procedure.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A printhead blotter system for an inkjet printing system employing an inkjet printhead with a nozzle array for ejecting droplets of ink, the blotter system comprising:

a blotter member;

a backer structure for supporting the blotter member during a blotting operation;

a fluid dispenser for dispensing a cleaning fluid onto the blotter or the backer member;

a mechanism coupled to the backer structure to move the backer toward the printhead nozzle array to an engagement position, or away from the printhead to a rest position, the mechanism for engaging or disengaging the blotter with the printhead nozzle array.

2. The system of claim 1, wherein the blotter member is an elongated blotter structure, the system further comprising:

a dispenser system for supporting the blotter relative to the backer structure and moving the blotter to move a used portion of the blotter away from the backer structure and position a fresh portion of the blotter over the backer structure.

3. The system of claim 2 wherein the blotter member is in the form of a roll, and wherein the dispenser system includes a feed roll for holding unused portions of the blotter member, and a take-up roll for storing used portions of the blotter member.

4. The system of claim 3 wherein the feed roll and the take-up roll are positioned on opposite sides of the backer structure, supporting a portion of the roll in position on the backer structure.

5. The system of claim 3 further comprising a mechanism for rotating the take-up roll to take up a portion of the member and thereby position a fresh portion of the member over the backer structure.

6. The system of claim 1 wherein the cleaning fluid is de-ionized water.

7. The system of claim 1 further comprising a fluid pump for pumping the cleaning fluid to the fluid dispenser.

8. The system of claim 7 further comprising a fluid reservoir for holding a supply of the cleaning fluid, the reservoir in fluid communication with the pump.

9. The system of claim 1 wherein the blotter member is a sponge member.

10. The system of claim 1 wherein the blotter member is a capillary structure for applying a capillary force on the cleaning fluid.

11. The system of claim 10 wherein the blotter member is fabricated as a long strip.

12. The system of claim 10 wherein the blotter member is a woven fabric structure.

13. The system of claim 1, wherein the backer structure comprises a rigid support member and a compliant layer interposed between the rigid support member and the blotter member.

14. A printhead blotter system for an inkjet printing system employing an inkjet printhead with an orifice plate for ejecting droplets of ink, the blotter system comprising:

an elongated fabric blotter member for exerting a capillary force on liquid absorbed into the member;

a backer structure for supporting a portion of the blotter member to be used for a given blotting operation, the blotter portion passed over the backer structure during the blotting operation;

a fluid dispenser for dispensing a cleaning fluid onto the blotter portion or the backer member in response to electrical dispensing signals from a controller;

a mechanism coupled to the backer structure to move the backer toward the printhead orifice plate to an engagement position, or away from the printhead to a rest position in response to backer control signals from the controller, the mechanism for engaging or disengaging the blotter portion with the printhead orifice plate.

15. The system of claim 14, further comprising:

a dispenser system for supporting the blotter relative to the backer structure and moving the blotter to move a used portion of the blotter away from the backer structure and position a fresh portion of the blotter over the backer structure.

16. The system of claim 15 wherein the blotter member is in the form of a roll, and wherein the dispenser system includes a feed roll for holding unused portions of the blotter member, and a take-up roll for storing used portions of the blotter member.

17. The system of claim 16 wherein the feed roll and the take-up roll are positioned on opposite sides of the backer structure, supporting a portion of the roll in position on the backer structure.

18. The system of claim 16 further comprising a mechanism for rotating the take-up roll to take up a portion of the member and thereby position a fresh portion of the member over the backer structure.

19. The system of claim 14 wherein the cleaning fluid is de-ionized water.

20. The system of claim 14 further comprising a fluid pump for pumping the cleaning fluid to the fluid dispenser.

21. The system of claim 20 further comprising a fluid reservoir for holding a supply of the cleaning fluid, the reservoir in fluid communication with the pump.

22. The system of claim 14, wherein the backer structure comprises a rigid support member and a compliant layer interposed between the rigid support member and the blotter portion.

23. A method for cleaning a printhead orifice plate of an inkjet printhead, comprising:

positioning the printhead at a service station;

dispensing fluid on a blotter member;

urging the wetted blotter member into contact with the orifice plate of the printhead to clean the orifice plate;

positioning the wetted blotter member out of contact with the orifice plate.

24. The method of claim 23 wherein the step of urging the wetted blotter member into contact with the orifice plate comprises:

positioning the blotter member on a backer structure;

moving the backer structure toward the orifice plate, carrying the blotter member into contact with the orifice plate.

25. The method of claim 23, wherein the blotter member is an elongated member in roll form, and further comprising:

advancing the blotter member to position a fresh portion of the blotter member for engagement with the orifice member.

26. The method of claim 23, further comprising:

wiping debris from the orifice plate.

27. The method of claim 26, wherein the step of wiping debris from the orifice plate includes wiping the orifice plate with a wiper blade.

28. The method of claim 23 wherein the cleaning fluid is de-ionized water.

29. The method of claim 23 further comprising activating the printhead to spit ink from the orifice plate.

30. The method of claim 23, further comprising:

actuating the printhead to spit ink through the orifice plate while the wetted blotter member is in contact with the orifice plate.

31. The method of claim 23, wherein said dispensing fluid onto a blotter member comprises:

dispensing fluid in several increments during a single blotting procedure.

32. The method of claim 23, further comprising:

with the wetted blotter member in contact with the orifice plate, moving the printhead in a dithering movement to provide a wiping effect on the orifice plate.

33. A method for cleaning a printhead orifice plate of an inkjet printhead mounted on a movable carriage, comprising:

providing a roll of a textile blotter member;

advancing the roll to position a fresh portion of the blotter member for a service operation;

moving the carriage to a service station;

dispensing fluid on the portion of the blotter member;

urging the wetted blotter member into contact with the orifice plate of the printhead to clean the orifice plate;

positioning the wetted blotter member out of contact with the orifice plate.

34. The method of claim 33, further comprising:

actuating the printhead to spit ink through the orifice plate while the wetted blotter member is in contact with the orifice plate.

35. The method of claim 33, wherein said dispensing fluid onto a blotter member comprises:

dispensing fluid in several increments during a single blotting procedure.

36. The method of claim 33, further comprising:

with the wetted blotter member in contact with the orifice plate, moving the printhead in a dithering movement to provide a wiping effect on the orifice plate.

* * * * *